US008465101B1

(12) United States Patent
Alvarez

(10) Patent No.: US 8,465,101 B1
(45) Date of Patent: Jun. 18, 2013

(54) GUARD DEVICE FOR FURNITURE

(76) Inventor: Dawn R. Alvarez, Key Largo, FL (US)

( * ) Notice: Subject to any disclaimer, the term of this patent is extended or adjusted under 35 U.S.C. 154(b) by 349 days.

(21) Appl. No.: 13/010,561

(22) Filed: Jan. 20, 2011

(51) Int. Cl.
*A47B 97/00* (2006.01)

(52) U.S. Cl.
USPC ..... 297/463.2; 297/182; 297/188.08; 297/440.1

(58) Field of Classification Search
USPC ..... 297/440.22, 440.1, 440.14, 188.08, 297/188.09, 188.1, 182, 463.1, 463.2; 248/678, 248/188.1, 346.07, 345.1; 5/658, 659
See application file for complete search history.

(56) References Cited

U.S. PATENT DOCUMENTS

| | | | | |
|---|---|---|---|---|
| 618,264 | A * | 1/1899 | Burtless | 5/58 |
| 2,771,127 | A * | 11/1956 | Cole | 297/182 |
| 2,836,229 | A | 5/1958 | Spetner | |
| 4,252,372 | A | 2/1981 | Harder, Jr. | |
| 4,948,195 | A | 8/1990 | Saunders | |
| 5,000,512 | A * | 3/1991 | Laird | 297/440.1 |
| 5,392,475 | A * | 2/1995 | McCall et al. | 5/18.1 |
| 5,518,309 | A | 5/1996 | St-Pierre | |
| 5,603,474 | A * | 2/1997 | Weber | 248/127 |
| 5,913,501 | A * | 6/1999 | Heuss et al. | 248/346.07 |
| 6,367,880 | B1 * | 4/2002 | Niederman et al. | 297/440.14 |
| D484,338 | S | 12/2003 | Lenger | |
| 7,523,989 | B2 * | 4/2009 | Wieland et al. | 297/440.13 |
| 7,805,781 | B1 * | 10/2010 | Smith | 5/280 |
| 7,988,236 | B2 * | 8/2011 | Brandtner | 297/440.1 |
| 2003/0173814 | A1 * | 9/2003 | Wieland et al. | 297/440.1 |
| 2005/0103964 | A1 * | 5/2005 | Baechle | 248/346.01 |
| 2007/0063112 | A1 * | 3/2007 | Patterson | 248/188.6 |
| 2007/0134457 | A1 | 6/2007 | Dobelle | |
| 2009/0146040 | A1 * | 6/2009 | Small | 248/678 |
| 2009/0174248 | A1 * | 7/2009 | Chisholm | 297/463.2 |
| 2009/0235451 | A1 * | 9/2009 | Gorkin | 5/12.2 |

* cited by examiner

*Primary Examiner* — David Dunn
*Assistant Examiner* — Alexander Harrison

(57) ABSTRACT

A guard device for preventing accumulation of items under a piece of furniture featuring a center panel, a first extension plate, a second extension plate, a third extension plate, a fourth extension plate, and a back panel. The panel and extension plates removably attach to each other via attachment means and together form a barrier around a piece of furniture with the extension plates functioning as side panels. The attachment means allow the height, width, and length of the device to be adjusted to fit around the piece of furniture. The device also features securing tabs pivotally attached to the top edge of both the center panel and back panel. The securing tabs help keep the device secured around the furniture.

16 Claims, 5 Drawing Sheets

GUARD DEVICE FOR FURNITURE

FIELD OF THE INVENTION

The present invention is directed to a furniture accessory, more particularly to a guard device for furniture (e.g., couches, chairs, beds, etc.) for helping to block objects from rolling or sliding under a piece of furniture or other object. The device can also help prevent the accumulation of dust.

BACKGROUND OF THE INVENTION

It is extremely common for items to accumulate under furniture, such as chairs, beds, and couches. For example, children's toys (or pet's toys), shoes, and even food can easily slide underneath the furniture, making it difficult to retrieve the items. Oftentimes the furniture must be moved. The present invention features a guard device for placing around the outside or inside of furniture legs to help prevent the unwanted accumulation of items (e.g., shoes, toys, food, and other household items) under furniture. The present invention is not limited to use under a couch, for example the guard device may be used for tables, chairs, beds, and the like. The guard device can help reduce cleaning time, eliminate the need to move furniture to retrieve items, and even provide a decorative feature for the piece of furniture. The length, width, and depth of the device of the present invention can be adjusted via a means of a slot and post arrangement or rail and track device.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a guard device for preventing accumulation of items under a piece of furniture. In some embodiments, the guard device comprises a center panel having a first end, a second end, a front surface, a back surface, a top edge, and a bottom edge, the bottom edge of the center panel is adapted to face a ground surface with the front surface of the center panel facing forwardly; a first extension plate, the first extension plate is generally L-shaped having a first panel and a second panel perpendicular to each other, the first panel of the first extension plate is removably attached to an area of the back surface of the center panel at the first end via a first attachment means; a second extension plate, the second extension plate is generally L-shaped having a first panel and a second panel perpendicular to each other, the first panel of the second extension plate is removably attached to an area of the back surface of the center panel at the second end via a second attachment means; a third extension plate, the third extension plate is generally L-shaped having a first panel and a second panel perpendicular to each other, the first panel of the third extension plate removably attaches to the second panel of the first extension plate via a third attachment means; a fourth extension plate, the fourth extension plate is generally L-shaped having a first panel and a second panel perpendicular to each other, the first panel of the fourth extension plate removably attaches to the second panel of the second extension plate via a fourth attachment means, wherein the center panel, the first extension plate, the second extension plate, the third extension plate, and the fourth extension plate together form a barrier around a piece of furniture; and a first securing tab pivotally attached to the center panel at or near the top edge, and a second securing tab pivotally attached to the center panel at or near the top edge, the securing tabs can pivot between multiple positions including an up position extending upwardly from the center panel and positioned generally perpendicular to the center panel a down position generally parallel to the center panel, the securing tabs help to secure the guard device in place around a piece of furniture.

In some embodiments, the first attachment means allows placement of the first extension plate on the center bar to be adjustable, the second attachment means allows placement of the second attachment plate on the center bar to be adjustable, the third attachment means allows placement of the third extension plate on the first extension plate to be adjustable, and the fourth attachment means allows placement of the fourth extension plate on the second extension plate to be adjustable. In some embodiments, the first attachment means, the second attachment means, the third attachment means, and the fourth attachment means provide for a fixed length, width, and height of the guard device.

In some embodiments, the first attachment means, second attachment means, third attachment means, or fourth attachment means is a peg-and-hole mechanism, a rail and track mechanism, a telescopic mechanism, a hook-and-loop fastener mechanism, an adhesive mechanism, a screw mechanism, a tape mechanism, a clip mechanism, or a combination thereof. In some embodiments, first holes are disposed in the back surface of the center panel near the first end and second holes are disposed in the back surface of the center panel near the second end, a first peg is disposed on the first panel of the first extension plate, and a second peg is disposed on the first panel of the second extension plates, wherein the first peg and second peg are adapted to snugly engage the first holes and second holes, respectively.

In some embodiments, the guard device further comprises a back panel resembling the center panel, a first end of the back panel removably attaches to the second panel of the third extension plate via a fifth attachment means and a second end of the back panel removably attaches to the second panel of the fourth extension plate via a sixth attachment means.

In some embodiments, the fifth attachment means or the sixth attachment means includes a peg-and-hole mechanism, a rail and track mechanism, a telescopic mechanism, a hook-and-loop fastener mechanism, an adhesive mechanism, a screw mechanism, a tape mechanism, a clip mechanism, or a combination thereof. In some embodiments, first back panel holes are disposed in a back surface of the back panel at or near the first end and second back panel holes are disposed in the back surface of the back panel at or near the second end, wherein pegs on the second panel of the third extension plate and on the second panel of the fourth extension plate snugly engage the first back panel holes and second back panel holes, respectively.

In some embodiments, the guard device further comprises a third securing tab and a fourth securing tab both pivotally attached to the back panel at or near a top edge. In some embodiments, the guard device is constructed from a material comprising wood, plastic, metal, cardboard, foam, or a combination thereof.

In some embodiments, the guard device is secured to a piece of furniture via an elastic band mechanism, a tab mechanism, a hook-and-loop fastener mechanism, a tape mechanism, a pinning mechanism, a magnet mechanism, a bracket mechanism, or a combination thereof. In some embodiments, the center panel, the first extension plate, the second extension plate, the third extension plate, or the fourth extension plate is constructed in an accordion-style manner to allow for adjustability in length or width or height. In some embodiments, the center panel, the first extension plate, the second extension plate, the third extension plate, or the fourth extension plate can be folded. In some embodiments, the center panel, the first extension plate, the second extension plate, the third extension plate, or the fourth extension plate comprise elastic material allowing for adjustability in length or width or height.

DESCRIPTION OF PREFERRED EMBODIMENTS

Figure 1:
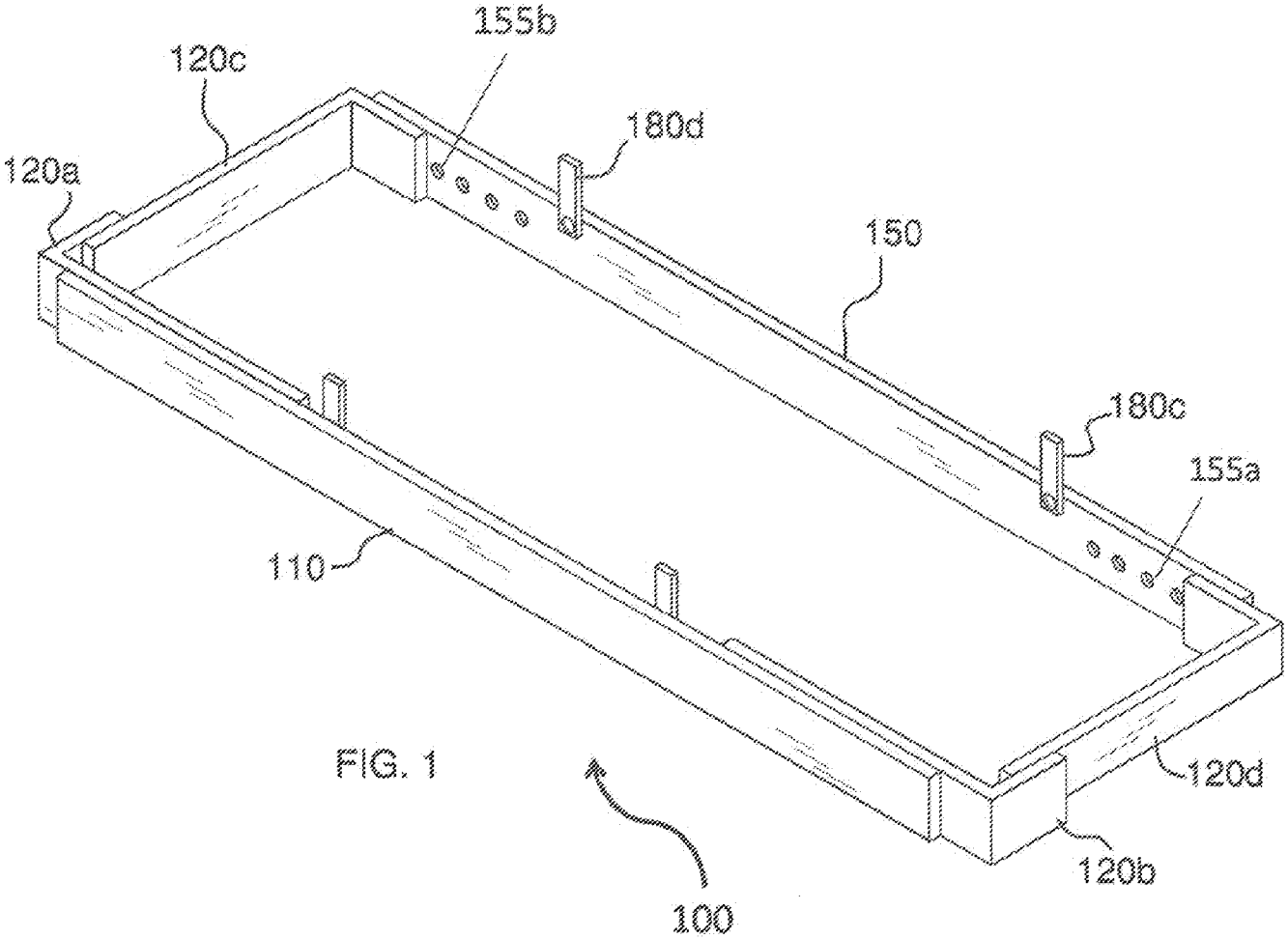
FIG. 1 is a perspective view of the guard device of the present invention.

Referring now to FIGS. 1-6, the present invention features a guard device 100 for placing around the outside or inside of furniture legs to help prevent the unwanted accumulation of items 102 (e.g., shoes, toys, food, and other household items) under a piece of furniture such as a couch 101, a table, a chair, a bed, and/or the like. The guard device 100 comprises a center panel 110 having a first end, a second end, a front surface, a back surface, a top edge, and a bottom edge. The center panel 110 is positioned generally perpendicularly to the ground surface (e.g., as shown in FIG. 1), wherein the front surface of the center panel 110 faces forwardly and the bottom edge of the center panel 110 contacts the ground surface (or near the ground surface). This configuration provides a barrier between the bottom edge of the piece of furniture and the ground surface.

Figure 2:
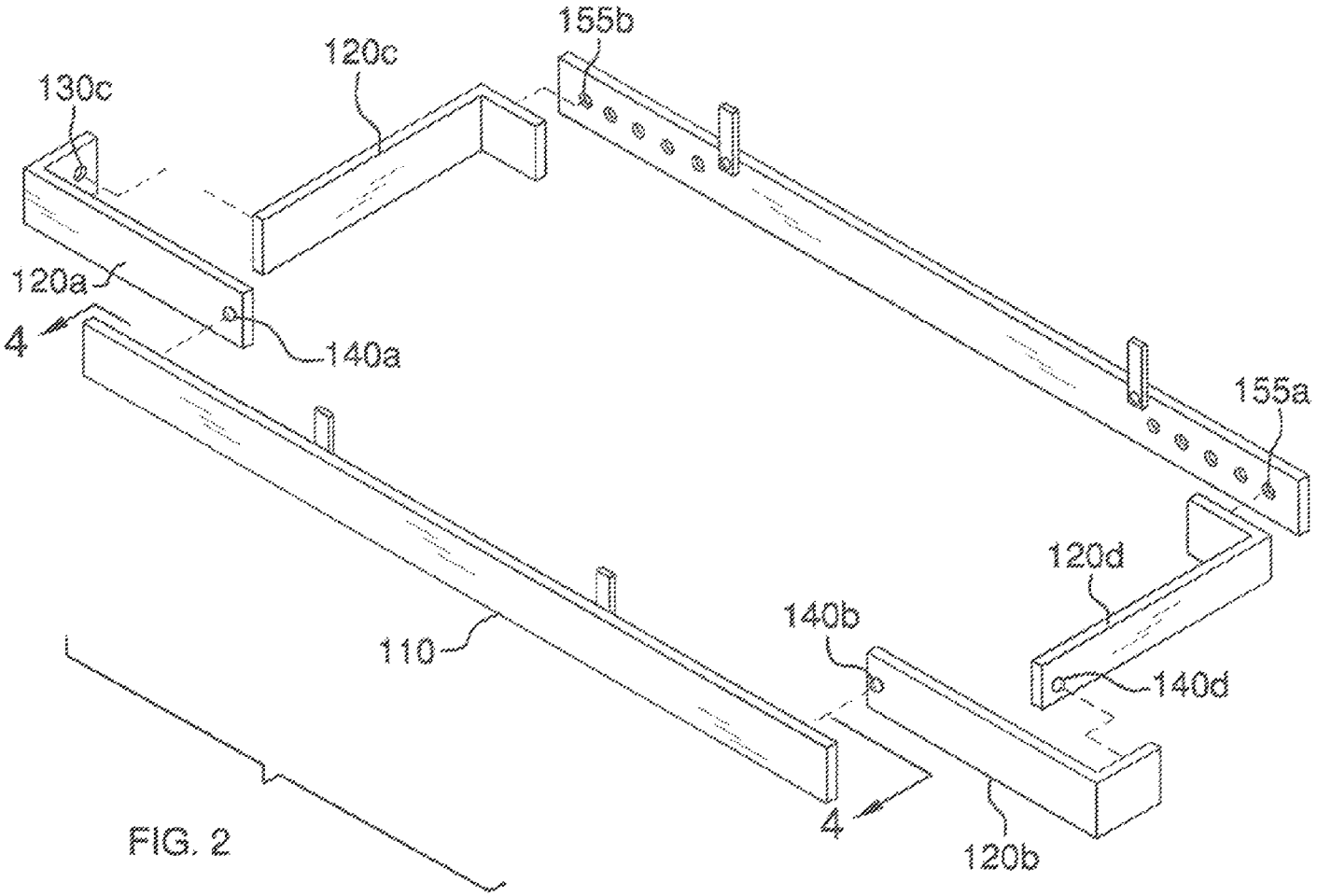
FIG. 2 is an exploded view of the guard device of FIG. 1.
Figure 3:
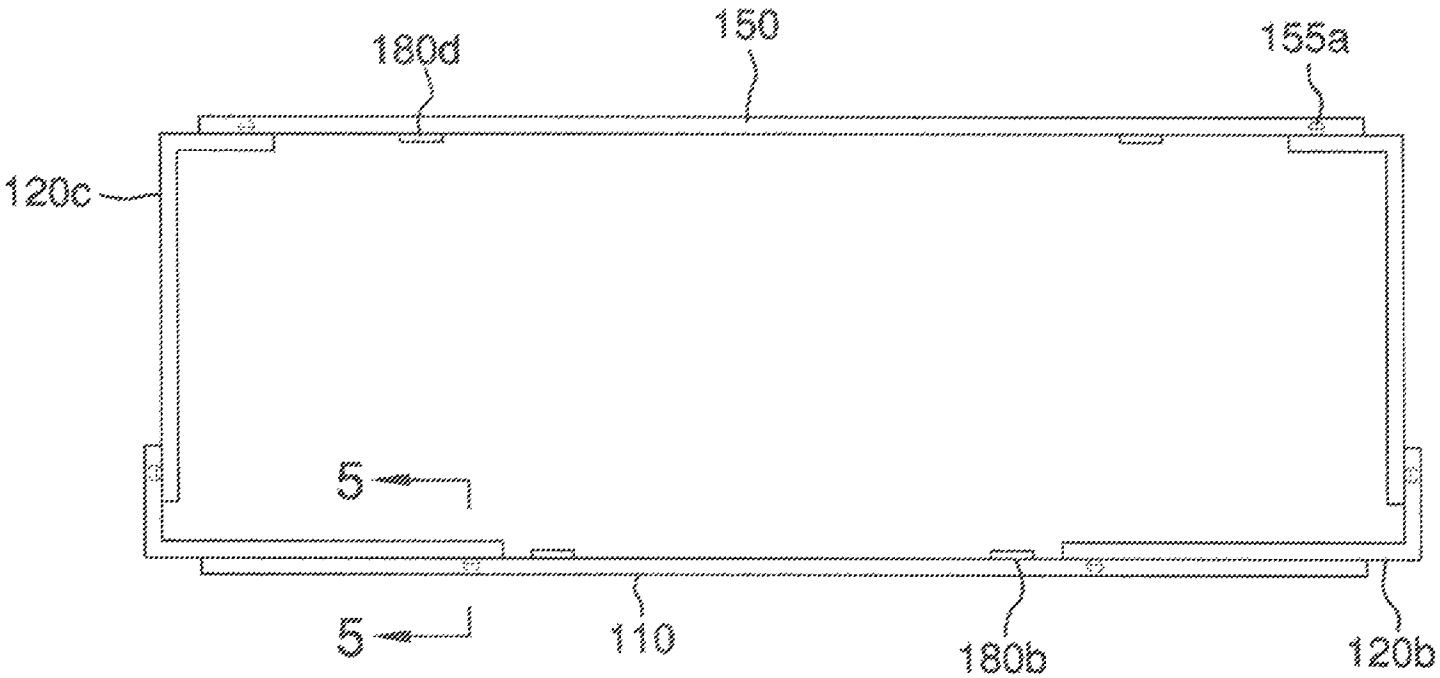
FIG. 3 is a top view of the guard device of FIG. 1.

The guard device 100 further comprises a first extension plate 120*a* removably attached to the back surface of the center panel 110 at or near the first end via a first attachment means. A second extension plate 120*b* is removably attached the back surface of the center panel 110 at or near the second end via a second attachment means. The extension plates 120 are generally L-shaped as viewed from above. For example, each extension plate 120 comprises a first panel and a second panel, wherein the second panel is positioned generally perpendicularly to the first panel, forming an L-shape. As shown in FIG. 1 and FIG. 2., the extension plates 120 are attached such that the first panel contacts the back surface of the center panel 110 and the second panel extends backwardly (e.g., perpendicularly to the center panel 110).

Figure 4:
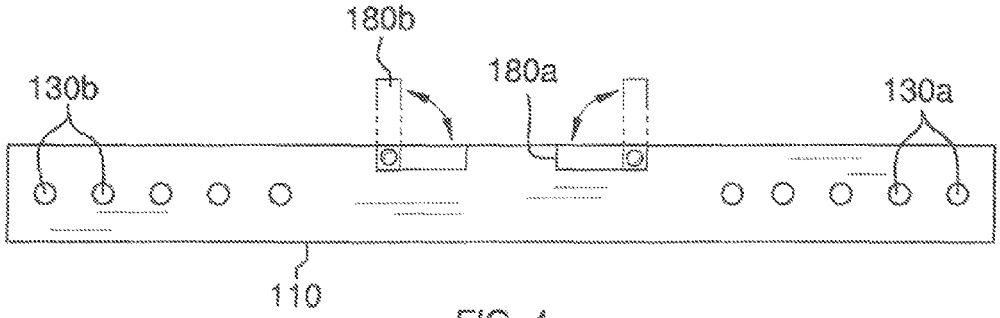
FIG. 4 is a back view of the center panel of the guard device of FIG. 2.
Figure 5:
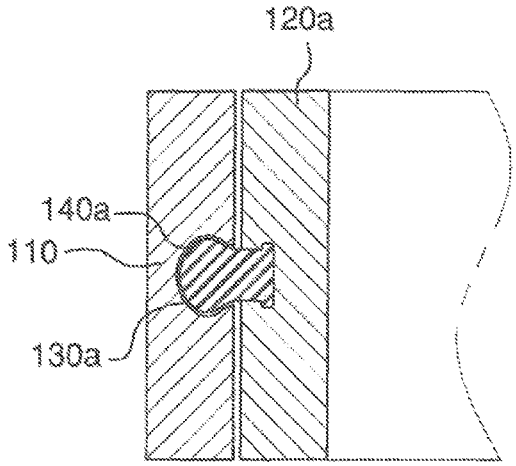
FIG. 5 is a side cross sectional view of the guard device of FIG. 3.
Figure 6:
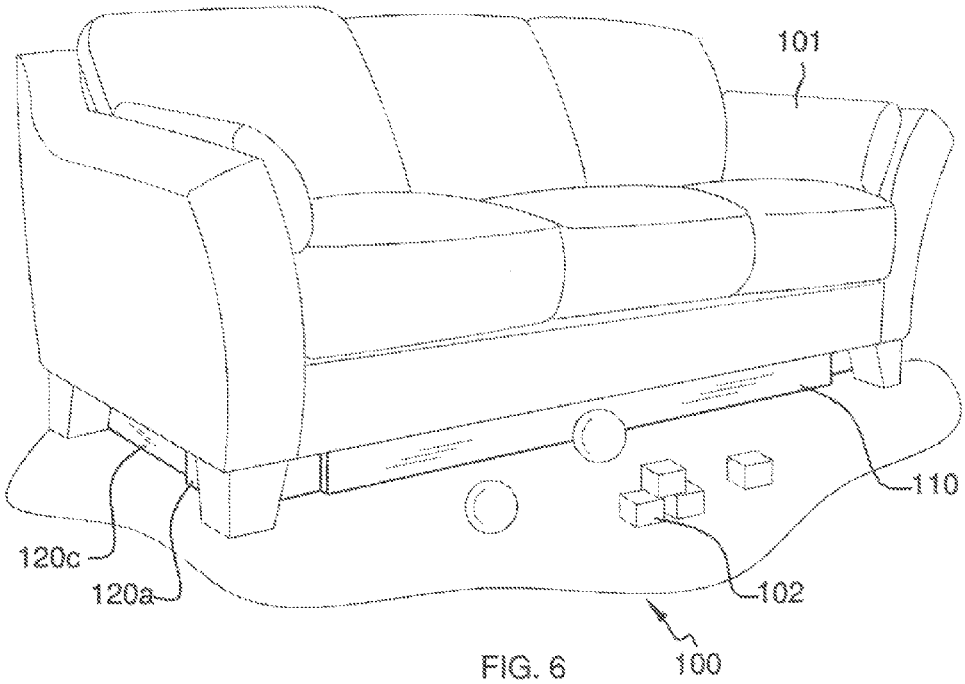
FIG. 6 is an in-use view of the guard device of the present invention.

The first and second extension plates 120 can attach to one of several places on the center panel 110. As shown in FIG. 4 and FIG. 5, the first attachment means and/or second attachment means may include a peg-and-hole mechanism, wherein first holes 130*a* are disposed in the back surface of the center panel 110 near the first end and second holes 130*b* are disposed in the back surface of the center panel 110 near the second end, and various pegs 140 (e.g., a first peg 140*a*, a second peg 140*b*) are disposed on the front surface of both the first and second extension plates 120. The pegs 140 of the first and second extension plates 120 are adapted to snugly (but removably) engage the holes 130. FIG. 2 shows a first peg 140*a* disposed on the end of the first panel of the first extension plate 120*a* and a second peg 140*b* disposed on the end of the first panel of the second extension plate 120*b*. In some embodiments, the first attachment means and second attachment means are a rail and track system.

The guard device 100 further comprises a third extension plate 120*c*, which engages the first extension plate 120*a* via a third attachment means, and a fourth extension plate 120*d*, which engages the second extension plate 120*b* via a fourth attachment means. For example, the first panel of the third extension plate 120*c* engages the second panel of the first extension plate 120*a* (see FIG. 2) via the third attachment means and the first panel of the fourth extension plate 120*d* engages the second panel of the second extension plate 120*b* via the fourth attachment means.

In some embodiments, the third attachment means and fourth attachment means includes a peg-and-hole mechanism. For example, a third peg is disposed on the first panel of the third extension plate 120*c*, which is adapted to snugly engage a third hole 130*c* disposed in the second panel of the first extension plate 120*a*. A fourth peg is disposed on the first panel of the fourth extension plate 120*d*, which is adapted to snugly engage a fourth hole disposed in the second panel of the second extension plate 120*b*. In some embodiments, the third attachment means and fourth attachment means are a rail and track system.

In some embodiments, the guard device 100 comprises an optional back panel 150, which may resemble the center panel 110 (e.g., having a first end, a second end, a front surface, a back surface, a top edge, and a bottom edge). The back panel 150 may attach to the third extension plate 120*c* and the fourth extension plate 120*d*. For example, the third extension plate 120*c* is removably attached to the back surface of the back panel 150 at or near the first end via a fifth attachment means, and the fourth extension plate 120*d* is removably attached to the back surface of the back panel 150 at or near the second end via a sixth attachment means.

The fifth attachment means and/or sixth attachment means may include a peg-and-hole mechanism, wherein first back panel holes 155*a* are disposed in the back surface of the back panel 150 at or near the first end and second back panel holes 155*b* are disposed in the back surface of the back panel 150 at or near the second end. Pegs are disposed on the second panel of the third extension plate 120*c* and on the second panel of the fourth extension plate 120*d*. The pegs of the third extension plate 120*c* and fourth extension plate 120*d* are adapted to snugly (but removably) engage the back panel holes 155. In some embodiments, the fifth attachment means and sixth attachment means is a rail and track system.

Pivotally attached to the center panel 110 at or near the top edge (e.g., near the first end) is a first securing tab 180*a* (e.g., a fold away stay), and pivotally attached to the center panel 110 at or near the top edge (e.g., near the second end) is a second securing tab 180*b* (e.g., a second fold away stay). The securing tabs 180 can pivot between multiple positions including a down position (e.g., see FIG. 4) and an up position (e.g., see FIG. 1). The securing tabs 180 help to secure the device 100 in place. For example, the securing tabs 180 can be moved to the down position while being assembled and then moved to the up position to prevent the device 100 from sliding around underneath the piece of furniture 101 (e.g., the securing tabs 180 contact the furniture and prevent movement of the device 100).

In some embodiments, a third securing tab 180*c* and a fourth securing tab 180*d* are pivotally attached to at or near the top edge of the back panel 150.

The length, width, and depth of the device of the present invention can be adjusted via a means of a slot and post system (peg-and-hole mechanism) or rail and track system.

The components of the device 100 of the present invention may be constructed in a variety of sizes, styles, designs, and colors as well as from a variety of materials. For example, in some embodiments, the device 100 of the present invention is constructed from a material similar to that of the piece of furniture (e.g., color, fabric, etc.). In some embodiments, the device 100 is constructed from a material comprising wood, plastic, metal, cardboard, foam, the like, or a combination thereof.

Without wishing to limit the present invention to any theory or mechanism, it is believed that the guard device 100 of the present invention is advantageous because the device 100 provides an enclosure for surrounding a portion of or all of the bottom area of a piece of furniture, wherein the enclosure is constructed from various interconnecting and adjustable pieces. The securing tabs 180 help keep the device 100 in place during use.

The disclosures of the following U.S. Patents are incorporated in their entirety by reference herein: U.S. Pat. No. 2,836,229; U.S. Pat. No. 5,518,309; U.S. Pat. No. 4,948,195; U.S. Pat. Application No. 2007/0134457; U.S. Pat. No. 4,252,372.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A guard device (100) for preventing accumulation of items under a piece of furniture, said guard device (100) comprising:

(a) a center panel (110) having a first end, a second end, a front surface, a back surface, a top edge, and a bottom edge, the bottom edge of the center panel (110) is adapted to face a ground surface with the front surface of the center panel (110) facing forwardly;

(b) a first extension plate (120*a*), the first extension plate (120*a*) is generally L-shaped having a first panel and a second panel perpendicular to each other, the first panel of the first extension plate (120*a*) is removably attached to an area of the back surface of the center panel (110) at the first end via a first attachment means;

(c) a second extension plate (120*b*), the second extension plate (120*b*) is generally L-shaped having a first panel and a second panel perpendicular to each other, the first panel of the second extension plate (120*b*) is removably attached to an area of the back surface of the center panel (110) at the second end via a second attachment means;

(d) a third extension plate (120*c*), the third extension plate (120*c*) is generally L-shaped having a first panel and a second panel perpendicular to each other, the first panel of the third extension plate (120) removably attaches to the second panel of the first extension plate (120*a*) via a third attachment means;

(e) a fourth extension plate (120*d*), the fourth extension plate (120*d*) is generally L-shaped having a first panel and a second panel perpendicular to each other, the first panel of the fourth extension plate (120*d*) removably attaches to the second panel of the second extension plate (120*b*) via a fourth attachment means, wherein the center panel (110), the first extension plate (120*a*), the second extension plate (120*b*), the third extension plate (120*c*), and the fourth extension plate (120*d*) together form a barrier around a piece of furniture; and (f) a first securing tab (180*a*) pivotally attached to the center panel at or near the top edge, and a second securing tab (180*b*) pivotally attached to the center panel at or near the top edge, the securing tabs (180) can pivot between multiple positions including an up position extending upwardly from the center panel (110) and positioned generally perpendicular to the center panel (110) a down position generally parallel to the center panel (110), the securing tabs 180 help to secure the guard device (100) in place around a piece of furniture.

2. The guard device (100) of claim 1, wherein the first attachment means allows placement of the first extension plate (120*a*) on the center panel (110) to be adjustable, the second attachment means allows placement of the second attachment plate (120*b*) on the center bar (110) to be adjustable, the third attachment means allows placement of the third extension plate (120*c*) on the first extension plate (120*a*) to be adjustable, and the fourth attachment means allows placement of the fourth extension plate (120*c*) on the second extension plate (120*b*) to be adjustable.

3. The guard device (100) of claim 1, wherein the first attachment means, the second attachment means, the third attachment means, and the fourth attachment means provide for a fixed length, width, and height of the guard device (100).

4. The guard device (100) of claim 1, wherein the first attachment means, second attachment means, third attachment means, or fourth attachment means is a peg-and-hole mechanism.

5. The guard device (100) of claim 1, wherein the first attachment means, second attachment means, third attachment means, or fourth attachment means includes a rail and track mechanism, a telescopic mechanism, a hook-and-loop fastener mechanism, an adhesive mechanism, a screw mechanism, a tape mechanism, a clip mechanism, or a combination thereof.

6. The guard device of claim 4, wherein first holes (130*a*) are disposed in the back surface of the center panel (110) near the first end and second holes (130*b*) are disposed in the back surface of the center panel (110) near the second end, a first peg (140*a*) is disposed on the first panel of the first extension plate (120*a*), and a second peg (140*b*) is disposed on the first panel of the second extension plates (120*b*), wherein the first peg (140*a*) and second peg (140*b*) are adapted to snugly engage the first holes (130*a*) and second holes (130*b*), respectively.

7. The guard device (100) of claim 1 further comprising a back panel (150) resembling the center panel (110), a first end of the back panel (150) removably attaches to the second panel of the third extension plate (120*c*) via a fifth attachment means and a second end of the back panel (150) removably attaches to the second panel of the fourth extension plate (120*d*) via a sixth attachment means.

8. The guard device of claim 7, wherein the fifth attachment means or the sixth attachment means includes a peg-and-hole mechanism.

9. The guard device (100) of claim 7, wherein the fifth attachment means or the sixth attachment means includes a rail and track mechanism, a telescopic mechanism, a hook-and-loop fastener mechanism, an adhesive mechanism, a screw mechanism, a tape mechanism, a clip mechanism, or a combination thereof.

10. The guard device (100) of claim 8, wherein first back panel holes (155*a*) are disposed in a back surface of the back panel (150) at or near the first end and second back panel holes (155*b*) are disposed in the back surface of the back panel (150) at or near the second end, wherein pegs on the second panel of the third extension plate (120*c*) and on the second panel of the fourth extension plate (120*d*) snugly engage the first back panel holes (155*a*) and second back panel holes (155*b*), respectively.

11. The guard device (100) of claim 7 further comprising a third securing tab (180*c*) and a fourth securing tab (180*d*) both pivotally attached to the back panel (150) at or near a top edge.

12. The guard device (100) of claim 1, wherein the guard device (100) is constructed from a material comprising wood, plastic, metal, cardboard, foam, or a combination thereof.

13. The guard device (100) of claim 1, wherein the guard device (100) is secured to a piece of furniture via an elastic band mechanism, a tab mechanism, a hook-and-loop fastener mechanism, a tape mechanism, a pinning mechanism, a magnet mechanism, a bracket mechanism, or a combination thereof.

14. The guard device (100) of claim 1, wherein the center panel (110), the first extension plate (120*a*), the second extension plate (120*b*), the third extension plate (120*c*), or the fourth extension plate (120*d*) is constructed in an accordion-style manner to allow for adjustability in length or width or height.

15. The guard device (100) of claim 1, wherein the center panel (110), the first extension plate (120*a*), the second extension plate (120*b*), the third extension plate (120*c*), or the fourth extension plate (120*d*) can be folded.

16. The guard device (100) of claim 1, wherein the center panel (110), the first extension plate (120*a*), the second extension plate (120*b*), the third extension plate (120*c*), or the fourth extension plate (120*d*) comprise elastic material allowing for adjustability in length or width or height.

* * * * *